United States Patent [19]

Lindh et al.

[11] Patent Number: 4,569,298

[45] Date of Patent: Feb. 11, 1986

[54] SIGNAL ARRANGEMENT IN A SEWING MACHINE

[75] Inventors: Per A. L. Lindh, Västerås; Kenneth O. E. Skogward, Huskvarna, both of Sweden

[73] Assignee: Husqvarna Aktiebolag, Huskvarna, Sweden

[21] Appl. No.: 466,335

[22] PCT Filed: Jun. 15, 1982

[86] PCT No.: PCT/SE82/00216

§ 371 Date: Feb. 7, 1983

§ 102(e) Date: Feb. 7, 1983

[87] PCT Pub. No.: WO82/04447

PCT Pub. Date: Dec. 23, 1982

[30] Foreign Application Priority Data

Jun. 16, 1981 [SE] Sweden ..... 81037673

[51] Int. Cl.[4] ..... D05B 69/36; D05B 45/00; G01N 21/30

[52] U.S. Cl. ..... 112/278; 112/273; 250/561; 242/37 R

[58] Field of Search ..... 112/278, 273, 279, 184, 112/181, 229, 228; 139/273 A; 250/561, 571, 222.1; 242/36, 37 R

[56] References Cited

U.S. PATENT DOCUMENTS

| | | | |
|---|---|---|---|
| 4,163,158 | 7/1979 | Coughenour et al. | 250/561 |
| 4,192,243 | 3/1980 | Blessing et al. | 112/273 |
| 4,212,257 | 7/1980 | Herron et al. | 112/278 |
| 4,216,733 | 8/1980 | Kornatowski | 112/273 X |
| 4,237,807 | 12/1980 | Meier | 112/273 X |
| 4,331,090 | 5/1982 | Hanyu et al. | 112/229 |

*Primary Examiner*—Peter Nerbun

*Attorney, Agent, or Firm*—Alfred E. Miller

[57] ABSTRACT

A signal arrangement for supplying a signal as a pre-warning to the operator of a sewing machine, when the bobbin thread is about to run out. The bobbin has a reflective center, and a radiation source and detectors are mounted in the loop-taker. A friction clutch may be provided between the bobbin and the loop-taker, so that the bobbin rotates in one direction when thread is wound thereon, and the other direction when all of the thread has unwound therefrom.

6 Claims, 5 Drawing Figures

SIGNAL ARRANGEMENT IN A SEWING MACHINE

Figure 1:
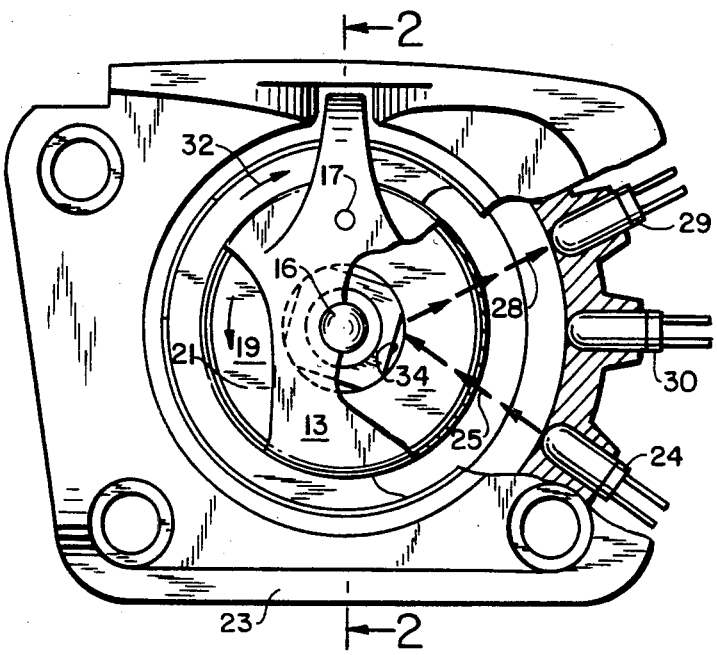

The present invention relates to an arrangement for supplying a signal pre-warning the operator of a sewing machine of the fact that the thread on a bobbin is about to run out.

Arrangements for immediate detection of the thread content of a bobbin are known in which several principles based on several kinds of signals have been used. Mechanical devices, such as lever arms, sensing the thread content and putting a sound source into action when a predetermined minimum is reached have, however, the drawback of poor accuracy and of making the change of the bobbin difficult. By the introduction of an optic detection by means of a photoelectric cell, mechanical components can be omitted, but the accuracy is still bad. Therefore, it is considered necessary to develop this system by making use of distinct points of measuring etc. whereby the accuracy is improved.

In the present invention a signal arrangement is provided with a light source and a light sensor directed to a reflecting surface on the bobbin body which reflects the light when the bobbin is nearly empty. A reflection is then received by the sensor which applies a signal to an electronic unit from which a warning signal is passed to the operator. At this moment there is still thread on the bobbin but if the sewing proceeds so that the thread goes out pulses of reflected light will occur in a predetermined order in dependence on the positions of the source and the sensor, respectively. These pulses release another signal from the electronic unit by which (for example) the sewing is stopped.

The advantage of such an arrangement is achieved therein that the sewing can proceed until the thread has in practice run out. Moreover, the drawbacks of mechanical detection arrangements as mentioned in the foregoing are eliminated.

An example of an embodiment of the invention will be described in the following with reference to the accompanying drawing, which shows in FIG. 1 a vertical projection of a shuttle mechanism of a sewing machine, in FIG. 2 the same mechanism in a cross section at the arrows II—II of FIG. 1, in FIG. 3 an exploded sketch of the shuttle mechanism, in FIG. 4 the same projection as in FIG. 1 but with the bobbin in another position and in FIG. 5 a block diagram of a decoder.

The Figures show the whole shuttle mechanism including the signal arrangement according to the invention. The mechanism comprises a loop taker 10 on a carrier 11 having a horizontally journalled shaft 12 so that a bobbin case 13 is inserted into the loop taker from the side and is retained there by a releasable latch 14 engaged in an annular groove 15 on a bobbin shaft 16. The bobbin case can be released from the shaft and removed by rotating the latch about a pin 17. Arranged in the bobbin case is an exit 18 for thread from a bobbin 19 located in the case. At the exit a leaf spring 20 projects under which the thread is pressed against the surface of the case and is thus tensioned. The bobbin is inserted in the case in such a manner that it rotates in the direction of the arrow 21 when the thread is pulled out therefrom. In its wall the case has an opening 22 extending about half the way around the periphery of the case so that the bobbin is visible through the opening. The entire mechanism is assembled under a loop taker cover 23 which by means of screws is secured to a bearing bracket in the sewing machine body.

Figure 3:
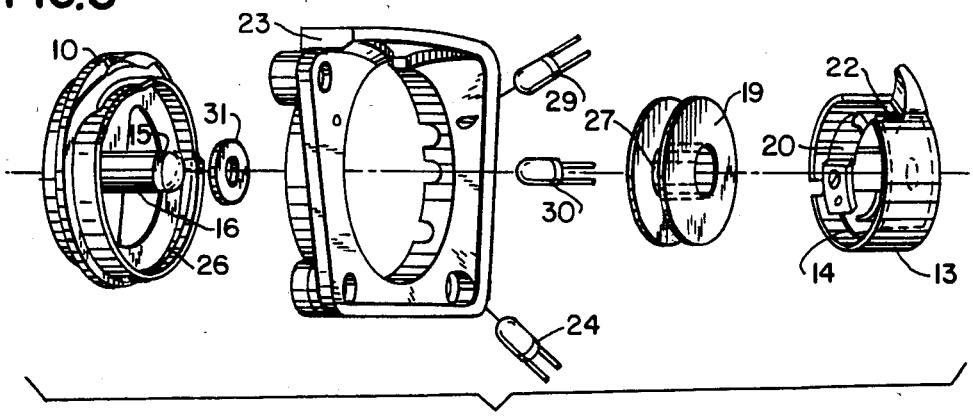
Figure 4:
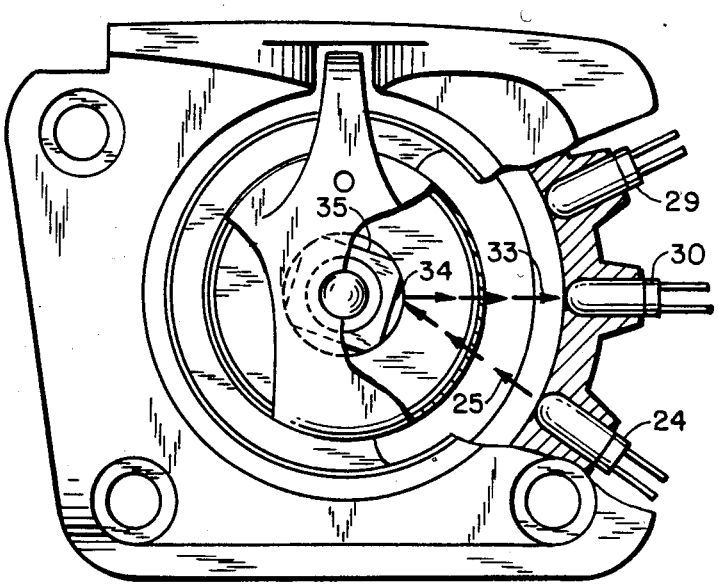
Figure 5:
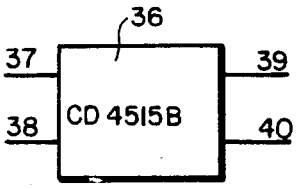

The design of the signal arrangement of this embodiment is shown in FIGS. 1, 3 and 4. In a plan perpendicular to the bobbin shaft 16 electronic components are inserted, each one into its hole in the loop taker cover 23 and directed to the bobbin shaft. One component is a lamp (LED or the like) 24, the light beam of which is shown by arrows 25 in FIGS. 1 and 4. The beam passes through the opening 22 and a fissure 26 in the loop taker towards the central portion 27 of the bobbin 19. This portion has a plurality of plane surfaces of a reflecting material which reflects the light along the arrows 28 through the fissure and the opening against someone of the other components which are phototransistors 29, 30 connected by output wires to a decoder. Between the loop taker and the bobbin a ring 31 of an elastic material is disposed which presses against the bobbin and tends to rotate it in the direction of rotation of the loop taker according to the arrow 32. By rotation through a small angle in this direction the light is reflected according to the arrows 33 (FIG. 4) and after another small rotation the surface 34 leaves the light beam and no light is reflected. If the rotation of the bobbin continues the surface 35 enters into the beam and light is reflected to the phototransistors according to FIGS. 1 and 4, respectively.

Figure 2:
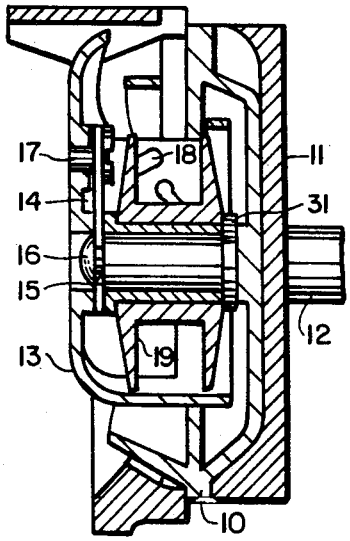

When there is thread on the bobbin in several layers and the bobbin is inserted as shown in FIG. 2 it rotates in the direction opposite to the loop taker when thread is pulled out, in doing this the end surface of the bobbin slips against the ring 31. The light beam from the lamp hits the wound thread but is not reflected. When less than one layer of the thread remains the surfaces 34, 35 are uncovered and hit by the light beam which is reflected. Depending on the direction of rotation (arrow 21) the transistor 30 is first hit and then the transistor 29. The direction of rotation is thus expressed by the sequence of the electric pulses from the transistors. As soon as the thread has run out the bobbin is let free and starts rotating in the direction of rotation of the loop taker (arrow 32). The sequence of the electric pulses will then be inverted in relation to the former.

The signals mentioned in the foregoing relating to the pre-warning and the ending of the thread, respectively, will now be explained with the said inversion of the pulse sequence as a condition. The pre-warning signal occurs when less than one layer of thread remains at a rotation according to the arrow 21. A stop signal occurs when the thread comes off the bobbin, which then reverses. The two signals have referred to can be generated in a decoder 36. The latter can for instance be constituted by a TTL-(transistor-transistor-logic) standard circuit No. CD 4515B (FIG. 5). The two inputs 37, 38 of the wires from the transistors 29, 30 receives pulses in a positive or a negative sequence—assuming that positive is the sequence when the bobbin rotates according to the arrow 21 and negative when in the opposite direction. At the positive pulse sequence the decoder supplies a voltage on the output 39. As said in the foregoing, the pulses first occur during the rotation of the bobbin according to the arrow 21, when the thread is about to run out, and then during the rotation of the bobbin according to the arrow 32, when the thread has come off the bobbin, which then follows the rotation of the loop taker. During the positive sequence (signal 39) a pre-warning is given, e.g. a lamp is lit, and during the negative sequence (signal 40) the machine stops.

The system now described can be simplified and adapted for only pre-warning when the thread is about to run out, i.e. when the bobbin body appears under the thread winding and causes reflections. Such a simple system constitutes the substantial idea of the invention and is defined in the following claims.

We claim:

1. In a signal arrangement for a sewing machine for sensing and indicating the thread condition on a bobbin, wherein a reflective surface is provided on a central portion of the bobbin adapted to be uncovered when thread on the bobbin is about to run out, a light source is mounted to direct a light beam to the reflective surface, and a first sensor is mounted to receive light of said beam reflected from said reflective surface at a first angular orientation of the axis of said bobbin with respect to said light beam; the improvement comprising a second sensor positioned to receive light of said beam reflected from said reflective surface at a second angular orientation of the axis of said bobbin with respect to said beam that is different from said first angular orientation, whereby the beam is reflected from said reflective surface at different moments to said first and second sensors during the rotation of the bobbin, in an order dependent upon the direction of rotation of said bobbin, said arrangement further comprising a decoder coupled to said first and second sensors and responsive to the times of receipt of signals from the first and second sensors for producing output signals that are different for different directions of rotation of said bobbin.

2. A signal arrangement according to claim 1, wherein the bobbin is connected by means of a friction clutch to a drive member included in the machine and rotating in the direction for winding thread on the bobbin, said clutch being adjusted to enable slippage between the bobbin and the drive member when thread is being unwound from the bobbin while rotating said bobbin in a direction for winding thread on said bobbin when thread has run out from said bobbin.

3. A signal arrangement according to claim 2, wherein the bobbin is driven by the stitch-forming elements of the machine in the unwinding direction when thread is unwound, but by the friction clutch in the direction for winding when the thread content is out.

4. A signal arrangement according to claim 3, wherein the friction clutch is constituted of a ring of an elastic material positioned between the bobbin and a loop-taker included in the stitch-forming elements.

5. A signal arrangement according to claim 4, wherein the light source and the sensors are positioned in a loop-taker cover included in the stitch-forming elements.

6. A signal arrangement according to claim 1, wherein said reflector is made of plane mirror surfaces on the central portion of the bobbin or of prismatic bodies formed in the bobbin material.

* * * * *